United States Patent [19]

Lyman

[11] Patent Number: 4,597,131

[45] Date of Patent: Jul. 1, 1986

[54] MOUNTING FOR MOTOR-FAN UNIT

[75] Inventor: John B. Lyman, Bloomington, Minn.

[73] Assignee: Whirlpool Corporation, Benton Harbor, Mich.

[21] Appl. No.: 632,124

[22] Filed: Jul. 16, 1984

[51] Int. Cl.[4] ..... A47L 9/22

[52] U.S. Cl. ..... 15/412; 417/363

[58] Field of Search ..... 15/412; 417/363

[56] References Cited

U.S. PATENT DOCUMENTS

| | | | |
|---|---|---|---|
| 2,036,056 | 3/1936 | Kroenlein | 15/412 X |
| 2,036,058 | 3/1936 | Lang | 417/363 |
| 2,221,572 | 11/1940 | Brock et al. | 55/248 |
| 2,228,750 | 1/1941 | Brock | 417/363 X |
| 2,328,038 | 8/1943 | Taylor | 417/363 X |
| 2,652,902 | 9/1953 | Sheahan | 55/373 |
| 2,656,897 | 10/1953 | Yonkers, Jr. | 55/471 |
| 2,691,424 | 10/1954 | Sebok | 55/276 |
| 2,843,314 | 7/1958 | Hansen | 417/363 |
| 2,875,466 | 3/1959 | Nyberg | 417/363 X |
| 2,987,241 | 6/1961 | Lindsjo et al. | 417/363 |
| 3,031,129 | 4/1962 | Gaudry | 417/363 |
| 3,101,889 | 8/1963 | Tatge | 417/363 |
| 3,257,784 | 6/1966 | Grellsson | 55/472 |
| 3,320,725 | 5/1967 | Foster | 55/283 |
| 3,339,867 | 9/1967 | Bayless | 248/2 |

*Primary Examiner*—Chris K. Moore

*Attorney, Agent, or Firm*—Wood, Dalton, Phillips, Mason & Rowe

[57] ABSTRACT

Improved mounting structure for mounting a motor and fan unit to a housing support of a vacuum cleaner for preventing transmission of vibrations and sound from the motor and fan unit to the housing in the operation of the vacuum cleaner. The mounting structure includes a resilient mounting ring arranged to be under compression and bending in supporting the motor-fan unit to the housing support wall. A rigid ring is carried on a resilient ring and, in turn, carries the motor-fan unit so that forces generated by the motor-fan unit must pass through a space between the motor-fan unit and the circumjacent support wall. The resilient ring is clamped to the upper end of the support wall by presser elements engaging lugs on the resilient ring extending upwardly through suitable openings in the overlying rigid wall. The resilient ring further defines a resilient support for a pressure switch.

30 Claims, 5 Drawing Figures

FIG. 3
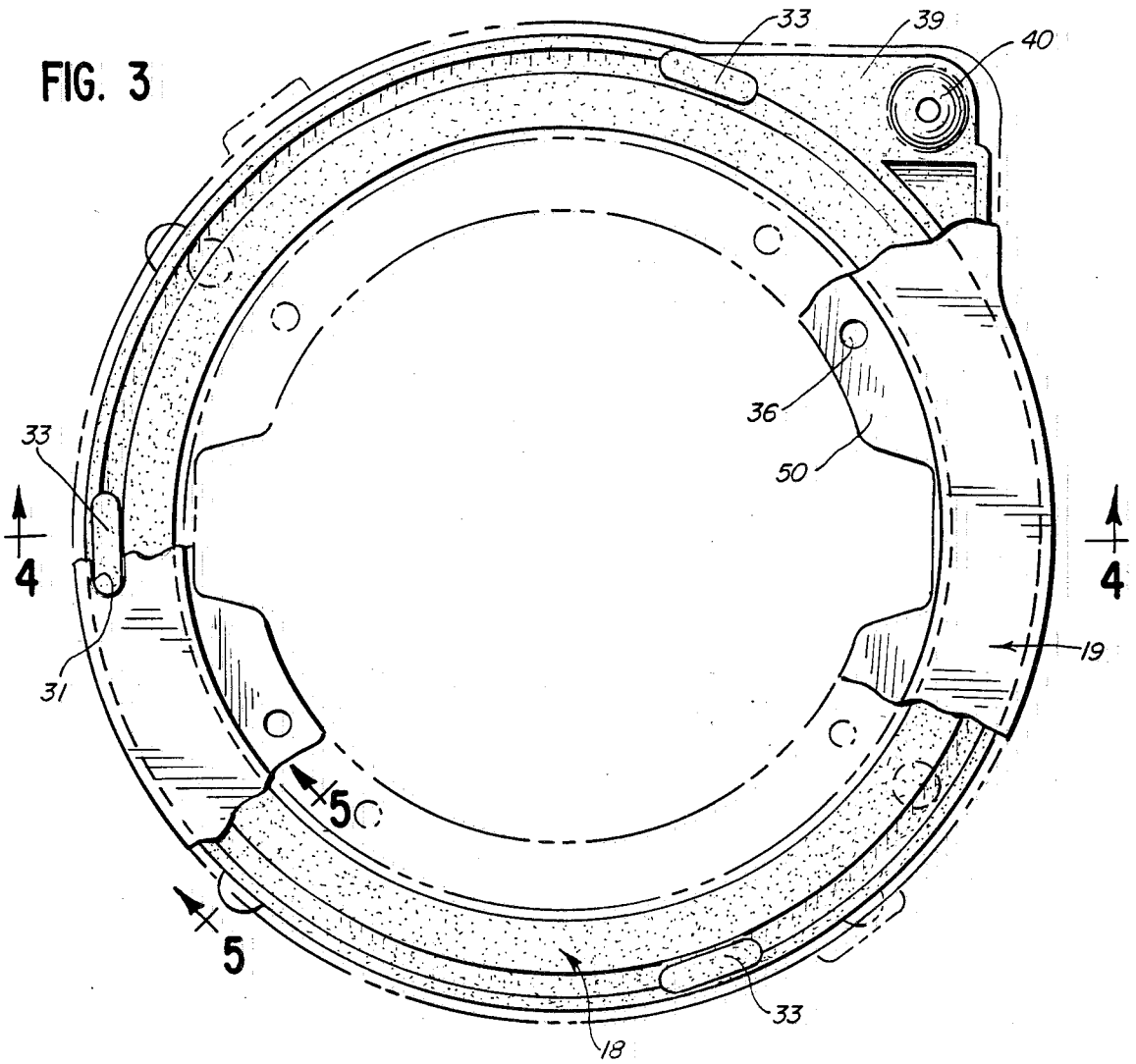
FIG. 4
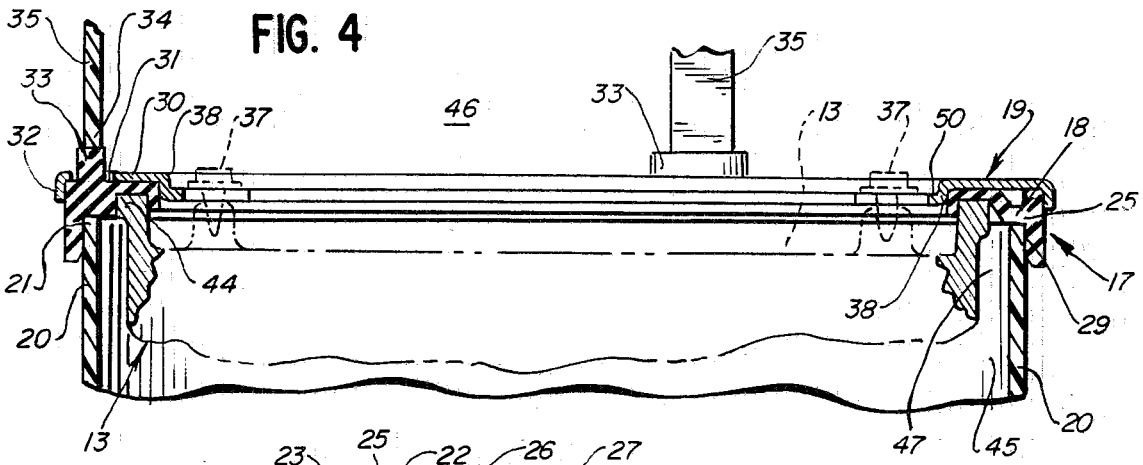
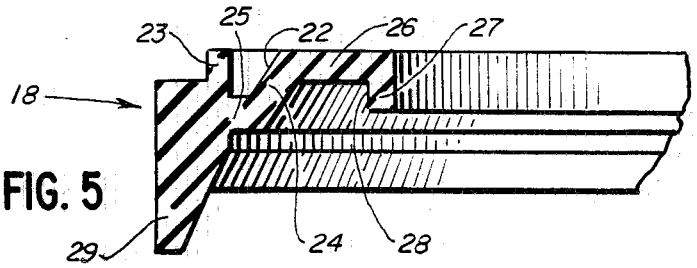
FIG. 5 and a rigid ring 19. Housing 16 defines an annular support wall 20 having an upper end 21. Resilient ring 18 rests on end 21 of the support wall and rigid ring 19 embraces the resilient ring in overlying relationship thereto, as best seen in FIG. 4.

More specifically, the resilient ring 18 is formed of a suitable resilient or elastomeric material, such as rubber, and is provided with an axially upwardly opening recess 22 having a trapezoidal cross section. At the radially outer portion of recess 22, ring 18 defines an upstanding radially outer annular flange 23. At the radially inner end of the recess 22, ring 18 defines a radially inner, axially upstanding inclined annular flange 24.

As further seen in FIG. 5, ring 18 further defines a radially extending wall 25 between flanges 23 and 24. As seen in FIG. 4, wall portion 25 is the portion of the ring 18 which rests on the upper end 21 of the housing support wall 20.

Extending radially inwardly from flange 22 of ring 18 is a radial annular wall 26 provided at its radially distal inner end with a downturned annular flange 27. Thus, as further seen in FIG. 5, the flange 24, wall 26 and flange 27 cooperatively define a second trapezoidal section recess 28 opening axially downwardly.

Mounting ring 18 further defines a radially outer depending annular flange 29. As shown in FIG. 4, flange 29 embraces the radially outer surface of support wall end 21 in the installed arrangement of the mounting ring 18.

As best seen in FIG. 4, rigid ring 19 includes a radially outer, radially extending annular wall 30 provided with a plurality of angularly spaced openings 31. The radially distal outer edge of the wall portion 30 is defined by a downturned annular flange 32, which embraces the outer surface of the resilient ring 18. As best seen in FIGS. 2 and 3, resilient ring 18 is provided with equiangularly spaced, upstanding lugs 33, which project through openings 31 so as to be engaged by the lower end 34 of a corresponding plurality of depending presser elements 35. As seen in FIG. 4, the presser elements 35 are aligned with the housing wall 20 so as to urge the resilient ring 18 directly downwardly against the upper end 21 thereof, and thereby clamp a portion of the resilient ring securely to the support wall, while yet permitting the rigid ring 19 to remain free of mechanical contact directly with any portion of the housing, and more specifically with the support wall 20.

As further shown, rigid ring 19 includes a radially inner annular portion 50 having a plurality of openings 36 adapted to pass suitable screws 37 for mounting the motor-fan unit 13 to the rigid ring 19. As seen in FIG. 4, wall portion 50 is joined to wall portion 30 of ring 19 by a turned annular flange portion 38. As seen in FIG. 4, flanges 32 and 38 cooperate with radial wall portion 30 in embracing the resilient ring 18 with the rigid ring 19, thusly supported firmly on the resilient ring and thereby supporting the motor-fan unit 13 resiliently through the resilient ring on the housing support wall 20.

As illustrated in FIG. 2, the motor-fan unit 13 is provided with a plurality of bosses 51 adapted to receive screws 37 in mounting the motor-fan unit to the rigid ring 19 of the mounting means 17.

The invention further comprehends the provision on the resilient ring 18 of a radially outwardly projecting portion 39 provided with a grommet 40 for supporting a pressure switch 41. As further shown in FIG. 2, rigid ring 19 includes a corresponding radially outwardly projecting portion 42 provided with a suitable opening 43 through which the grommet 40 is accessible to the switch 41 for resiliently mounting the switch to the mounting means 17.

Thus, the mounting means 17 includes a resilient compression support ring formed of a suitable elastomeric material, such as rubber, neoprene, or the like, arranged to support a rigid component of the mounting means free of contact with the vacuum cleaner support wall so as to effectively cushion vibrations of the motor-fan unit 13 as a result of the permitted free movement of the motor-fan unit afforded by the intermediate resilient ring. As illustrated, the elastomer of the resilient ring is in bending in supporting the motor-fan unit with improved vibration transfer prevention characteristics. The support of the rigid ring is on relatively thin flange portions 23 and 24 of the resilient ring, providing improved vibration transfer prevention for superior isolation of the sounds and vibrations developed in the motor-fan unit during operation of the vacuum cleaner.

Rigid ring 19 may be formed of a suitable strong material, such as steel, and is resiliently carried on ring 18 independent of mechanical contact with any portion of the vacuum cleaner housing.

The mounting screws 37 are spaced from the radially inner portion of the resilient ring for further improved isolation of sound and vibration.

As further shown in FIG. 4, the resilient mounting ring 18 is urged against an uppermost annular portion 44 of motor-fan unit 13 and cooperates with the engagement of wall portion 25 with the upper end 21 of the support wall 20 in effectively sealing the motor-fan unit to the housing so as to provide an effective seal between the suction space 45 in housing 11 and the discharge space 46 therein.

As further illustrated in FIG. 4, an annular space 47 is provided between the motor-fan unit 13 and the inner surface of support wall 20. Thus, the mounting arrangement prevents exertion of any line of force from the motor and suction fan unit 13 straight to the housing portion 20, notwithstanding the fact that the annular wall 20 is closely spaced to the motor-fan unit.

Thus, the mounting means 17 defines a resilient isolation mount for a vacuum cleaner motor-fan unit wherein the unit is somewhat free to move relative to the vacuum cleaner housing in a controlled fashion such that vibrations and sounds from the unit are prevented from being transmitted to the housing of the vacuum cleaner. The mounting means includes a resilient ring which further serves to provide a positive air seal between the suction and discharge sides of the suction fan. The mounting means supports the motor-fan unit so as to be spaced from the housing by an air space in such a manner that no line of force can be exerted straight from the motor-fan unit to any point on the vacuum cleaner body without passing through that air space.

The resilient ring is provided with an annular recess of trapezoidal cross section in its top surface defining thin upright support legs spaced by a horizontal wall resting on the housing support wall. The horizontal wall portion 25 has a thickness similar to that of the thin support legs, and each of these portions of the resilient ring bend and deform under load conditions to provide improved isolation of vibration forces and noise generated in the operation of the motor-fan unit. The radially outermost of the upright flanges 23 is disposed radially outwardly of the support wall 20 for improved resilient support of the motor-fan unit.

MOUNTING FOR MOTOR-FAN UNIT

BACKGROUND OF THE INVENTION

1. Field of the Invention

This invention relates to vacuum cleaners and in particular to means for mounting the motor and fan unit of a vacuum cleaner to the housing thereof.

2. Description of the Background Art

In one conventional form of vacuum cleaner construction wherein a motor and fan unit is mounted to the housing of a canister portion of such a vacuum cleaner, a rubber mounting ring is cantilevered from an annular support wall of the housing. The motor and fan unit is secured to the radially inner portion of the mounting ring so as to support the motor and fan unit resiliently with the mounting ring being placed under tension in effecting such support.

A vacuum cleaner construction utilizing a rubber support ring for the motor and fan unit is illustrated in U.S. Pat. No. 2,036,058, of Henry T. Lang. Themounting means includes a pair of resilient rings.

Robert B. Tatge, in U.S. Pat. No. 3,101,889, discloses a resilient mounting for a motor and fan unit wherein the unit is mounted to the radially inner portion of a rubber ring, the radially outer portion of which is mounted to the housing.

SUMMARY OF THE INVENTION

The present invention comprehends an improved means for mounting a coupled motor and fan unit in a vacuum cleaner to provide for a slight degree of movement relative to the housing thereof and yet effectively free of transmission of vibrations from the motor and fan unit to the housing in the operation of the vacuum cleaner.

In the illustrated embodiment, the support means cooperatively define, with the housing, a suction space and a discharge space at opposite sides of the fan. The resilient support provides a positive seal between the housing and the coupled motor and fan unit, which defines a correspondingly positive seal between the suction and discharge spaces.

In the illustrated embodiment, the support means cooperatively defines means for defining a space between the motor and suction fan unit and the housing, and preventing exertion of any line of force from the motor and suction fan unit straight to the housing.

Still further, the invention comprehends such a support means for use in a vacuum cleaner comprising means for isolating vibration forces generated by the motor during operation thereof, the resilient support means including a resilient ring having an axially opening recess of trapezoidal cross section defining at radially opposite sides thereof thin, generally axially extending concentric flanges, and at the axially inner end thereof, a radially extending wall between the axially extending flanges, the motor and fan unit being supported on the axially extending flanges and the radially extending wall being supported on the housing.

The invention further comprehends the provision of such support means comprising means for isolating vibration forces generated by the motor during operation thereof, the resilient support means including a resilient ring having a pair of radially spaced thin, generally axially extending annular flanges and a thin radially extending wall between the axially extending flanges, the housing defining a wall having an annular end, the motor and fan unit being supported on the axially extending flanges and the radially extending wall being supported on the upper end of the wall, with one of the axially extending annular flanges disposed radially inwardly of the wall end and the other of the axially extending annular flanges disposed radially outwardly thereof.

The invention further comprehends the provision of such a vacuum cleaner wherein the housing defines an upright wall having an annular end, and an upper wall having depending spaced elements aligned with the upright wall end, the depending elements bearing downwardly on the resilient support to clamp it against the upright wall end, with said coupled motor and fan spaced from the housing.

In the illustrated embodiment, the resilient support defines a ring having a radially inner portion embracing an upstanding portion of the coupled motor and fan, a radially outer portion resting on an annular portion of the housing, the inner and outer portions defining spaced upstanding annular supports on which the rigid support means rests.

Still further, the invention comprehends the provision of such a resilient mounting ring defining a radially outwardly projecting portion defining means for mounting an electrical pressure switch thereto.

The improved vacuum cleaner structure of the present invention is extremely simple and economical of construction, while yet providing a substantially improved mounting of the motor and suction fan unit to the housing for long, troublefree life.

BRIEF DESCRIPTION OF THE DRAWING

Other features and advantages of the invention will be apparent from the following description taken in connection with the accompanying drawing wherein:

FIG. 3 is a top plan view of the motor and fan unit mounting means with portions broken away for facilitated illustration thereof;

FIG. 4 is a diametric section taken substantially along the line 4—4 of FIG. 3; and FIG. 5 is a fragmentary enlarged transverse section of the resilient ring of the mounting means.

DESCRIPTION OF THE PREFERRED EMBODIMENT

Figure 1:
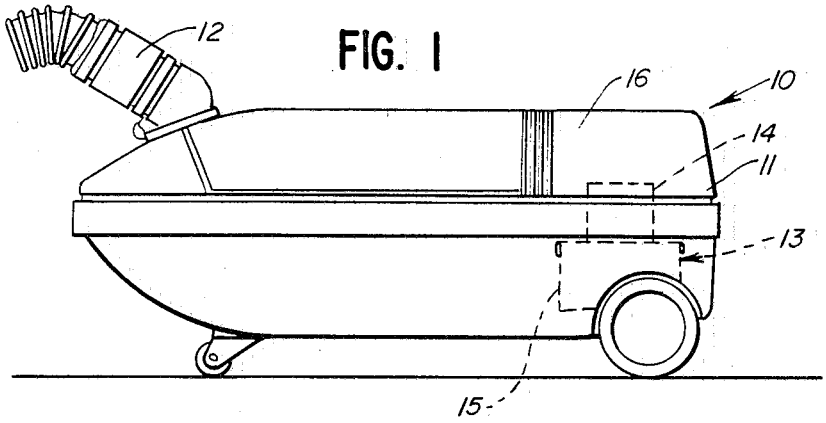
FIG. 1 is a side elevation of a canister portion of a vacuum cleaner provided with a motor and suction fan unit mounting means embodying the invention.
Figure 2:
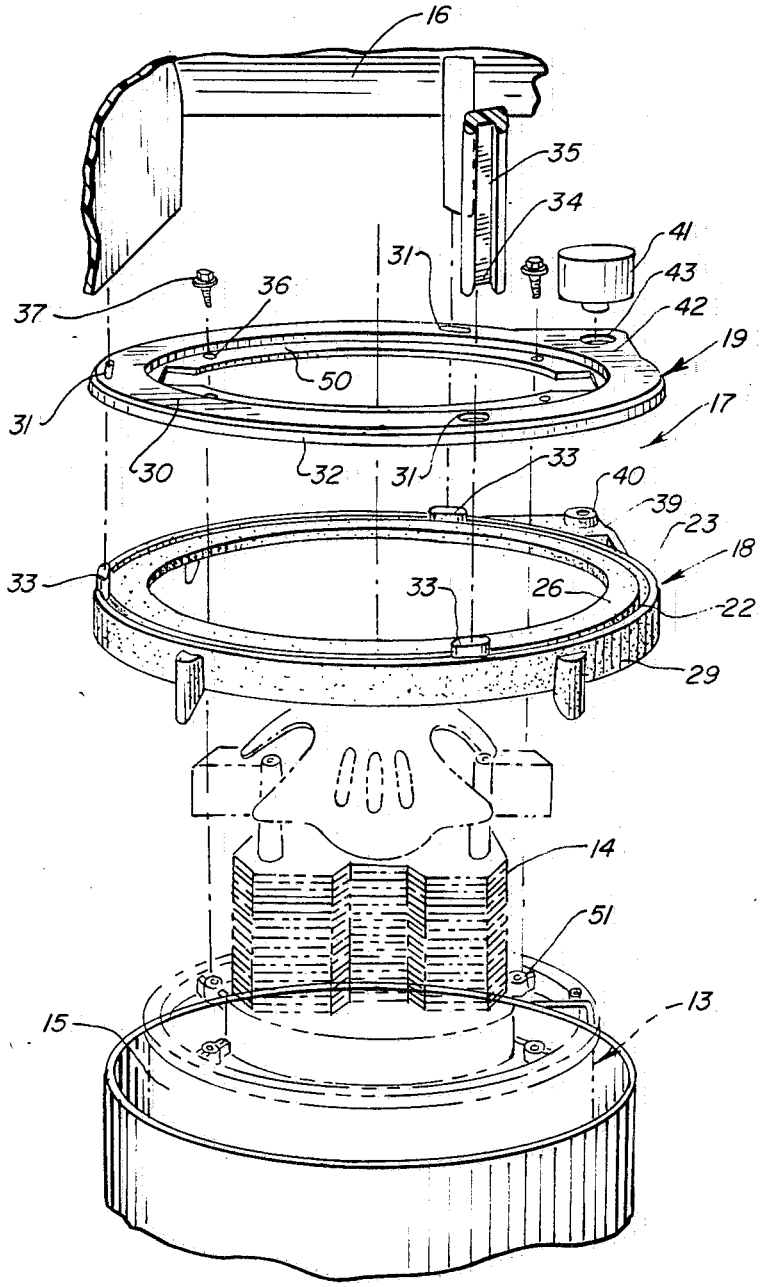
FIG. 2 is a fragmentary exploded perspective view illustrating the invention in greater detail.

In the exemplary embodiment of the invention as disclosed in the drawing, a vacuum cleaner structure generally designated 10 illustratively comprises a canister 11 to which is connected a suction hose 12 which may include electrical conductors for utilization with a power nozzle or with a dirt pickup wand (not shown) of conventional construction. The present invention is concerned with the mounting of a coupled motor-suction fan unit 13, including an electric motor 14 and a suction fan 15. As shown in FIG. 1, the motor fan untit 13 is mounted within a rear portion of the canister housing 16. The present invention comprehends an improved means generally designated 17 for mounting the motor and fan unit resiliently to the housing.

As best seen in FIG. 4, mounting means 17 includes a combined support means defined by a resilient ring 18

More specifically, the upright support portions of the resilient mounting ring are disposed on opposite sides of the support wall 20. A depending flange on the resilient ring is disposed radially outwardly of the support wall in embracing relationship thereto for further improved mounting of the motor-fan unit to the support wall.

The foregoing disclosure of specific embodiments is illustrative of the broad inventive concepts comprehended by the invention.

I claim:

1. In a vacuum cleaner having a housing, and a motor and suction fan unit in said housing, improved means for mounting the motor and fan unit to the housing comprising:

resilient support means carried by the housing; and rigid support means mounted to the motor and fan unit and resting on said resilient support means, said support means cooperatively defining combined support means for mounting the motor and fan unit resiliently to the housing for controlled free movement relative to the housing and effectively free of transmission of vibrations from the motor and fan unit to the housing in the operation of the vacuum cleaner, said combined support means comprising means for causing the resilient support means thereof to be subjected substantially to only compressive stress in supporting the motor and suction fan unit.

2. The vacuum cleaner mounting means of claim 1 wherein said combined support means comprises a resilient support ring carried by the housing and a rigid support ring carrying said coupled motor and fan unit resting on said resilient support ring, said motor and fan unit and said rigid support ring being free of engagement with said housing.

3. In a vacuum cleaner having a housing, a suction fan in said housing, and a motor and fan unit for selective driving thereof, improved means for mounting the motor and fan unit to the housing comprising:

resilient support means carried by the housing; and rigid support means mounted to the motor and fan unit and resting on said resilient support means and defining therewith a combined support means, said combined support means cooperatively defining with said housing a suction space and a discharge space at opposite sides of the combined support means, said resilient support means providing a positive seal between said housing and said motor and fan unit and defining a corresponding positive seal between said suction and discharge spaces, said combined support means comprising means for causing the resilient support means thereof to be subjected substantially to only compressive stress in supporting the motor and suction fan unit.

4. The vacuum cleaner mounting means of claim 3 wherein said rigid support means sealingly clamps said resilient support means to said motor and fan unit.

5. In a vacuum cleaner having a housing, and a motor and suction fan unit in said housing, improved means for mounting the motor and fan unit to the housing comprising:

resilient support means carried by the housing; and rigid support means mounted to the motor and fan unit and resting on said resilient support means and defining therewith a combined support means, said combined support means cooperatively defining a space between the motor and suction fan unit and said housing and preventing exertion of any line of force from said motor and fan unit straight to said housing, said combined support means comprising means for causing the resilient support means thereof to be subjected substantially to only compressive stress in supporting the motor and suction fan unit.

6. The vacuum cleaner mounting means of claim 5 wherein said housing includes an annular wall in closely spaced surrounding relationship to said motor and fan unit.

7. In a vacuum cleaner having a housing, a suction fan in said housing, and a motor and fan unit for selective driving thereof, improved means for mounting the motor and fan unit to the housing comprising:

resilient support means carried by the housing; and rigid support means mounted to the motor and fan unit and resting on said resilient support means and defining therewith a combined support means, said combined support means cooperatively defining means for isolating vibration forces generated by the motor during operation thereof, said resilient support means comprising a resilient ring having an axially opening recess of trapezoidal cross section defining at radially opposite sides of the recess thin generally axially extending concentric flanges and at the axially inner end thereof a radially extending wall between said axially extending flanges, said motor and fan unit being supported on said axially extending flanges and said radially extending wall being supported on said housing.

8. The vacuum cleaner mounting means of claim 7 wherein said radially extending wall has substantially the same thickness as that of said axially extending flanges.

9. The vacuum cleaner mounting means of claim 7 wherein the radially outer axially extending flange extends parallel to the axis of said resilient ring and the radially inner axially extending flange extends at an angle thereto.

10. The vacuum cleaner mounting means of claim 7 wherein said rigid support means comprises a ring having depending flanges embracing said resilient ring.

11. The vacuum cleaner mounting means of claim 7 wherein said resilient ring further includes a third axially extending flange extending oppositely to one of said concentric flanges to surround a portion of said housing.

12. In a vacuum cleaner having a housing, a suction fan in said housing, and a motor and fan unit for selective driving thereof, improved means for mounting the motor and fan unit to the housing comprising:

resilient support means carried by the housing; and rigid support means mounted to the motor and fan unit and resting on said resilient support means and defining therewith a combined support means, said combined support means cooperatively defining means for isolating vibration forces generated by the motor during operation thereof, said resilient support means comprising a resilient ring having a pair of radially spaced thin generally axially extending annular flanges and a thin radially extending wall extending between said axially extending flanges, said housing defining a wall having an annular upper end, said motor and fan unit being supported on said axially extending flanges and said radially extending wall being supported on said upper end of said housing wall with one of said axially extending annular flanges disposed radially inwardly of said wall end and the other of said axially extending annular flanges disposed radially outwardly thereof.

13. The vacuum cleaner mounting means of claim 12 wherein said one flange defines a radially inward distal portion extending radially therefrom.

14. The vacuum cleaner mounting means of claim 12 wherein said one flange defines a radially inward distal portion extending radially therefrom sand having a turned inner flange cooperating with said one flange to embrace an upper end portion of the motor and fan unit.

15. In a vacuum cleaner having a housing, a suction fan in said housing, and a motor and fan unit for selective driving thereof, improved means for mounting the motor and fan unit to the housing comprising:

resilient support means carried by the housing; and rigid support means mounted to the motor and fan unit and resting on said resilient support means and defining therewith a combined support means, said housing defining an upright wall having an upper annular end, and an upper wall having depending spaced elements aligned with said upright wall end, said depending elements bearing downwardly on said resilient support to clamp it against said upright wall end, with said coupled motor and fan spaced from said housing, said combined support means comprising means for causing the resilient support means thereof to be subjected substantially to only compressive stress in supporting the motor and suction fan unit.

16. The vacuum cleaner mounting means of claim 15 wherein said combined support means comprises annular members.

17. In a vacuum cleaner having a housing, a suction fan in said housing, and a motor and fan unit for selective driving thereof, improved means for mounting the motor and fan unit to the housing comprising:

resilient support means carried by the housing; and rigid support means mounted to the motor and fan unit and resting on said resilient support means and defining therewith a combined support means, said housing defining an upright wall having an upper annular end, and an upper wall having depending spaced elements aligned with said upright wall end, said depending elements bearing downwardly on said resilient support to clamp it against said uprighht wall end, with said coupled motor and fan spaced from said housing, said combined support means comprising means for causing the resilient support means thereof to be subjected substantially to only compressive stress in supporting the motor and suction fan unit, said rigid support means being providing with openings aligned with said depending elements and at least one of said resilient support means or said elements projects through said openings.

18. The vacuum cleaner mounting means of claim 17 wherein said resilient ring is provided with upstanding lugs projecting upwardly through said openings for engagement by said depending elements.

19. In a vacuum cleaner having a housing, a suction fan in said housing, and a motor and fan unit for selective driving thereof, improved means for mounting the motor and fan unit to the housing comprising:

resilient support means carried by the housing; and rigid support means mounted to the motor and fan unit and resting on said resilient support means and defining therewith a combined support means, said housing defining an upright wall having an upper annular end, and an upper wall having depending spaced elements aligned with said upright wall end, said depending elements bearing downwardly on said resilient support to clamp it against said upright wall end, with said coupled motor and fan spaced from said housing, said combined support means comprising means for causing the resilient support means thereof to be subjected substantially to only compressive stress in supporting the motor and suction fan unit, said resilient support means defining a pair of radially spaced, generally axially upwardly extending thin annular flanges supporting said rigid support means.

20. The vacuum cleaner mouting means of claim 19 wherein said thin annular flanges are disposed adjacent radially opposite sides of said upright wall end.

21. The vacuum cleaner mounting means of claim 19 wherein said thin annular flanges are disposed adjacent radially opposite sides of said upright wall end and said resilient support means further defines a depending radially outer, annular leg extending circumferentially about said upright wall end.

22. In a vacuum cleaner having a housing, a suction fan in said housing, and a motor and fan unit for selective driving thereof, improved means for mounting the motor and fan unit to the housing comprising:

resilient support means carried by the housing; and rigid support means mounted to the motor and fan unit and resting on said resilient support means and defining therewith a combined support means, said resilient support means defining a ring having a radially inner portion embracing an upstanding portion of said coupled motor and fan unit, a radially outer portion resting on an annular portion of said housing, said inner and outer portions defining spaced upstanding annular supports on which said rigid support means rests.

23. The vacuum cleaner mounting means of claim 22 wherein said rigid support means defines a ring having depending flanges embracing said resilient ring.

24. The vacuum cleaner mounting means of claim 22 wherein said rigid support means defines a ring having depending flanges embracing said resilient ring and radially inward support means secured fixedly to said coupled motor and fan.

25. The vacuum cleaner mounting means of claim 22 wherein said radially outer portion of the resilient support ring includes a depending flange embracing said housing.

26. The vacuum cleaner mounting means of claim 22 wherein said rigid support means applies compressive and bending forces to said resilient support means.

27. The vacuum cleaner mounting means of claim 22 wherein means are provided for clamping said resilient support to said housing at equiangularly spaced portions therof.

28. In a vacuum cleaner having a housing, a suction fan in said housing, and a motor and fan unit for selective driving thereof, improved means for mounting the motor and fan unit to the housing comprising:

resilient support means carried by the housing including a resilient ring; and rigid support means mounted to the motor and fan unit and resting on said resilient support means and defining therewith a combined support means, said combined support means defining a resilient mounting means for mounting the motor and fan unit resilientyly to the housing for controlled free movement relative to the housing and effectively free of transmission of vibrations from the motor and fan unit to the housing in the operation of the vacuum cleaner, said mounting means further defining a radially outwardly projecting portion defining switch mounting means for mounting an electrical pressure switch.

29. The vacuum cleaner mounting means of claim 28 wherein a grommet is provided on said switch mounting means for receiving a portion of said switch.

30. The vacuum cleaner mounting means of claim 28 wherein said combined support means comprises a rigid ring and a resilient mounting ring, said rigid ring defining an opening, a grommet being mounted to said switch mounting means and projecting through said opening for receiving a portion of said switch.

* * * * *